US008453577B2

(12) United States Patent
Gordon

(10) Patent No.: US 8,453,577 B2
(45) **Date of Patent: *Jun. 4, 2013**

(54) ROLLER COASTER MAINTENANCE VEHICLE AND METHODS OF USE

(76) Inventor: Jonathan I. Gordon, White Plains, NY (US)

( * ) Notice: Subject to any disclaimer, the term of this patent is extended or adjusted under 35 U.S.C. 154(b) by 106 days.

This patent is subject to a terminal disclaimer.

(21) Appl. No.: 12/760,897

(22) Filed: Apr. 15, 2010

(65) Prior Publication Data

US 2010/0224098 A1 Sep. 9, 2010

Related U.S. Application Data

(63) Continuation-in-part of application No. 11/870,481, filed on Oct. 11, 2007, now Pat. No. 7,743,710.

(51) Int. Cl.
*A63G 1/00* (2006.01)

(52) U.S. Cl.
USPC ..... 104/53; 104/307

(58) Field of Classification Search
USPC ..... 104/52, 138.1, 138.2, 2, 53, 307; 246/166
See application file for complete search history.

(56) References Cited

U.S. PATENT DOCUMENTS

| | | | | |
|---|---|---|---|---|
| 699,960 | A | 5/1902 | Lachase | |
| 850,136 | A | 4/1907 | Cole | |
| 1,621,337 | A | 3/1927 | Schmeck | |
| 1,741,286 | A | 12/1929 | Church | |
| 1,881,151 | A | 10/1932 | Traver | |
| 3,941,060 | A * | 3/1976 | Morsbach | 104/247 |
| 4,170,943 | A | 10/1979 | Achrekar | |
| 5,272,984 | A | 12/1993 | Bolliger et al. | |
| 5,595,121 | A | 1/1997 | Elliott et al. | |
| 5,623,244 | A | 4/1997 | Cooper | |
| 5,878,837 | A | 3/1999 | Kistner | |
| 6,550,393 | B2 | 4/2003 | Stengel | |
| 6,832,873 | B1 | 12/2004 | Kadrnoska et al. | |
| 7,131,382 | B2 | 11/2006 | Gordon | |
| 7,854,202 | B2 * | 12/2010 | Menser et al. | 104/127 |
| 2007/0031217 | A1 | 2/2007 | Sharma | |
| 2009/0025598 | A1 | 1/2009 | Menser et al. | |

OTHER PUBLICATIONS

Great Coasters International Inc. (www.greatcoasters.com) Jul. 31, 2003.
Translation of www.coaster.at, © 2006.
Mechanic's Padded Steel Creeper, Garage Pro Mechanic's Padded Steel Creeper, JC Whitney: Auto Parts and Accessories, available at www.jcwhitney.com, downloaded Jan. 26, 2007.

* cited by examiner

*Primary Examiner* — S. Joseph Morano
*Assistant Examiner* — Zachary Kuhfuss
(74) *Attorney, Agent, or Firm* — Gordon & Jacobson, PC

(57) ABSTRACT

A roller coaster maintenance vehicle includes a platform with a set of wheels arranged to ride on a roller coaster track structure. The platform includes a propulsion system which allows it to traverse the track structure independent of the roller coaster propulsion system. In one embodiment, a person rides on the vehicle and controls its movement. In another embodiment the vehicle is remotely controlled. Remotely controlled vehicles preferably include one or more inspection apparatus for inspecting the track structure. Optionally, the remotely controlled vehicles also include remotely controlled repair/maintenance equipment such as a robotic arm with a power tool coupled to its free end.

11 Claims, 12 Drawing Sheets

FIG 12
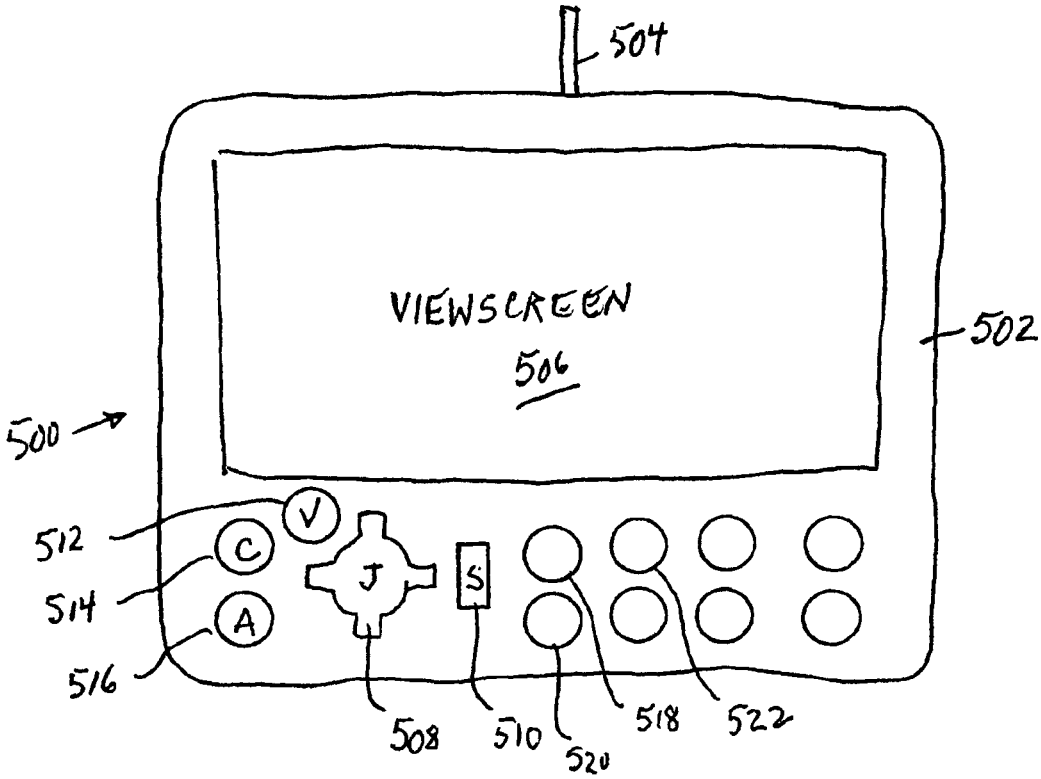
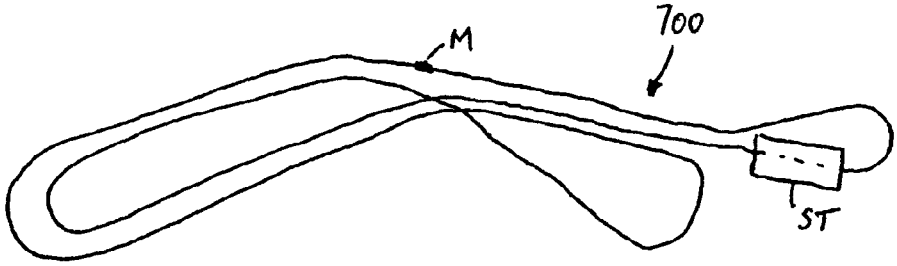
FIG. 12A
B

ROLLER COASTER MAINTENANCE VEHICLE AND METHODS OF USE

PRIORITY CLAIM AND INCORPORATION BY REFERENCE

This is a continuation-in-part of Ser. No. 11/870,481 filed Oct. 11, 2007 now U.S. Pat. No. 7,743,710 which is hereby incorporated by reference herein in its entirety. Reference may be had to U.S. Pat. No. 7,131,382, the complete disclosure of which is hereby incorporated herein by reference, in order to assist in understanding the present invention.

BACKGROUND OF THE INVENTION

1. Field of the Invention

This invention relates broadly to roller coaster maintenance. More particularly, this invention relates to vehicles employed for roller coaster maintenance and methods of maintaining roller coaster tracks.

2. State of the Art

Roller coasters have enjoyed immense popularity in the United States and elsewhere for over one hundred years. These rides often consist of a passenger carrying vehicle, or collection of vehicles joined together, which traverse along a track system. Historically, the track system typically comprised a pair of parallel rails which exhibit steep upward and downward gradients in elevation, and sharp left and right turns. Roller coaster cars are mounted on the track system and are propelled along the track system by a roller coaster propulsion system. The roller coaster propulsion system is arranged to tow roller coaster cars up steep track sections and then release them so that gravity operates to propel the cars down steep track sections, hence the term "coaster". Aside from supplying the passengers with a pleasing panoramic view from high elevations, the main objective of the roller coaster ride is to thrill the passengers by traversing the track at the fastest possible speed while maintaining an acceptable degree of safety. The thrill experienced by the passengers arises from the sensations of rapid acceleration, brought about through rapid changes in vertical and horizontal direction of movement. It can be said that the thrills are generally only experienced when the cars are ballistic. However, some modern coasters accelerate the cars under power prior to letting them go ballistic and the powered acceleration can also be thrilling.

Innovations in roller coaster design have sought to enhance and intensify passenger thrill by substantially increasing the speed of movement along the track system, and hence, the resulting forces of acceleration experienced by the passenger. These innovations were greatly facilitated by technological advances in materials engineering, a direct result of which enabled the construction of stronger and lighter track systems and passenger vehicles. However, attendant with ever increasing speeds of the passenger vehicles is the ever increasing risk of catastrophic failure of the ride.

My previously incorporated earlier patent discloses an amusement ride having a wood supported running track that is realized by two wooden track structures and a support beam that is disposed above the two wooden track structures and bridges the two wooden track structures. Metal strips are laid atop the wooden track structures. A passenger carrier (e.g., coaster car) has a frame structure with a first set of wheels mounted thereto that are adapted to run along the metal strips of the first and second wooden track structures during positive-g motion of the passenger carrier. At least one seat is suspended from the frame structure below the first set of wheels. This suspended wooden rail coaster design provides a distinctive rough, noisy, out of control feeling in addition to a distinctive feeling of freedom (and risk/danger), which are enjoyed by many roller coaster enthusiasts.

To guide the car during negative-g motion, a second pair of track structures arranged either above or below the two wooden track structures and the coaster car is provided with a second set of wheels which are arranged adjacent to the second pair of track structures. In addition, a third pair of track strictures and a third set of wheels are provided to guide the car against lateral-g motion.

Safety in roller coaster design and maintenance is of paramount importance. In the case of wooden coasters, maintenance personnel inspect the track on a daily basis and make repairs and maintenance as needed. Historically, the maintenance crew literally "walked the track" looking for loose bolts, weakened wood, etc. That procedure is still used today with modern wooden coasters. The suspended wood coaster and steel coasters cannot be inspected in that manner. Inspection and maintenance of steel coasters is typically performed with a cherry picker or the like.

SUMMARY OF THE INVENTION

The present invention provides methods and apparatus for inspecting and maintaining roller coasters. According to one aspect of the present invention roller coaster maintenance vehicles are provided which can be used to inspect and maintain all types of roller coasters. According to another aspect of the present invention a remotely operable roller coaster inspection and maintenance vehicle is provided.

More particularly, a first embodiment of the invention provides a self-propelled inspection/maintenance vehicle which rides along the roller coaster tracks under the control of an inspection/maintenance person riding in/on the vehicle. According to the first embodiment, the vehicle includes a horizontal platform having wheels which engage the track structures of my previously incorporated prior patent. The vehicle is designed to be operated by an inspection/maintenance person who is lying (prone or supine) on the horizontal platform. Since the platform will not maintain its horizontal orientation as the vehicle traverses the roller coaster track, a harness is provided to keep the inspection/maintenance person on the platform. The vehicle is also arranged such that the inspection/maintenance person's head is located between the track structures so that they can be inspected easily.

The vehicle of the first embodiment is self-propelled by a motor which drives a pinion (spur gear) and the roller coaster track is modified to include a "third rail" in the form of a toothed rack (cog) which is engaged by the pinion (spur gear). According to preferred embodiments, the vehicle is provided with a tool bin which extends downward from the horizontal platform. The tool bin is advantageously "self-righting" via an articulate coupling to the platform.

According to a second embodiment, an inspection/maintenance vehicle is provided with a platform having wheels designed to engage a conventional wooden roller coaster track. The platform is also provided with an inclined support for an inspection/maintenance person. The inclined support is designed to provide the inspection/maintenance person with a good view of the track structure. In the second embodiment, when repairs need to be made, the inspection/maintenance person can leave the vehicle and walk the sides of the track in a conventional manner. The second embodiment may be provided with the same propulsion system as the first embodiment. It is preferably provided with a safety restraint (e.g. handlebar or harness) for the inspection/maintenance person and a tool bin.

A third embodiment of the invention is similar to the second embodiment but is designed for use on a steel roller coaster track. An alternate third embodiment uses a somewhat different propulsion system referred to as "tires and fin". This system uses a vertical fin in place of the rack (cog) rail and a pair of horizontally mounted tires in place of the pinion (spur gear). The tires frictionally engage both sides of the fin so that when the tires are rotated, the vehicle is pushed along the track. The "tires and fin" propulsion system may be used in any of the embodiments.

The first three embodiments have commonality in that they are all self-propelled and independent of the coaster propulsion system. They are all under the control of the inspection/maintenance person who is riding on/in the vehicle and they all provide an orientation which allows the inspection/maintenance person a good view the track. They all preferably also provide a tool bin which may also be used to contain repair supplies such as wood, grease, nails, bolts, etc., in addition to tools. As described below in the detailed description, different modes of propulsion may be provided, preferably with an on-board power source. However, it is possible to use an external power source such as an electrical third rail. The controls for the propulsion system preferably allow control over the direction of movement and speed of movement. A reliable braking mechanism is preferably also provided. Optionally, each of these three embodiments may also include an on board source of compressed air for use with pneumatically driven tools. Other tools can also be provided such as an ultrasound inspection device and/or a welding kit for steel repairs.

According to a fourth embodiment of the invention, a remotely controlled inspection vehicle (incapable of making repairs or maintenance) is provided with one or more sensors and a transceiver. The sensors preferably include one or more video cameras arranged such that a remote operator may view real time images of the track structure on a remote video display. The cameras are preferably mounted on a powered gimbal (or the like) so that they can pan and tilt and are preferably provided with remotely operable zoom lenses. Thermal imaging with a video camera and an infrared heat source (or other appropriate equipment) can be provided to examine steel track structures for flaws and wooden track structures for deterioration. Ultrasound and audible sound sensors can also be used.

A fifth embodiment of the invention adds remotely controllable repair/maintenance equipment to the fourth embodiment. The remotely controllable equipment is in the nature of an industrial robot arm. For example, an articulate arm with an electrically or pneumatically powered bolt tightener is useful to maintain most track structures in use today. In some cases, a robotic arm with a nail gun may be useful. Remotely operated grease guns and/or a remotely operated welding kit may also be provided.

A sixth embodiment of the invention includes a cherry picker like bucket so that the inspection/maintenance person can stand while riding the vehicle.

Additional objects and advantages of the invention will become apparent to those skilled in the art upon reference to the detailed description taken in conjunction with the provided figures.

BRIEF DESCRIPTION OF THE DRAWINGS

FIG. 2 is a schematic side elevation view of the vehicle of FIG. 1;

FIG. 12 is a schematic block diagram of a remote controller for the fourth and fifth embodiments;

FIG. 12A is a schematic diagram showing a roller coaster track with a maintenance vehicle and a remote building which houses the remote controller of FIG. 12.

DETAILED DESCRIPTION

Figure 1:
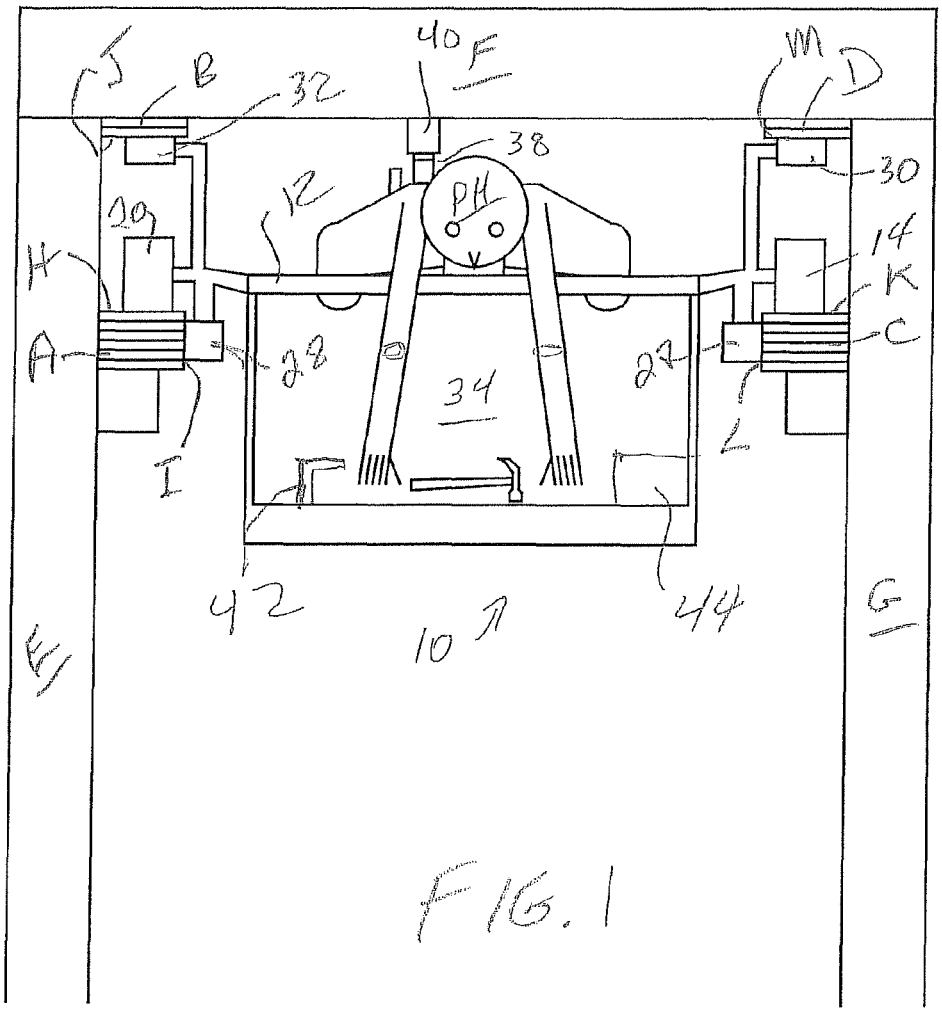
FIG. 1 is a schematic front elevation view of a first embodiment of a roller coaster maintenance vehicle according to the invention.

Turning now to FIGS. 1-5, a first embodiment of a roller coaster maintenance vehicle 10 is shown in conjunction with track structures similar to those disclosed in previously incorporated U.S. Pat. No. 7,131,382. Four track structures A, B, C, D are shown. The track structures are supported by timbers E, F, G, which are periodically located along the length of the track structures as illustrated, e.g., in FIG. 2 as F, F' and G, G'. The wooden track structures A and C are provided with metal strips or rails H, I and K, L, respectively. The wooden track structures B and D are provided with metal strips J and M respectively. All of the components A-M are assembled as described in my previously incorporated prior patent. From the foregoing it will be appreciated that six rails are provided upon which the vehicle 10 may ride: a pair of lower rails H and K, a pair of upper rails J and M, and a pair of side rails I and L.

Referring now to the maintenance vehicle 10, it includes a platform 12 having four lower wheels 14, 16, 18, 20 and four side wheels 22, 24, 26, 28. Two upper (up-stopping) wheels 30, 32 are preferably provided near the front of the vehicle for reasons which will be described immediately below. The lower wheels support the vehicle under positive-g force. The side wheels support the vehicle under lateral-g force and the upper wheels support the vehicle under negative-g force. According to the illustrated embodiment, the platform 12 is also provided with a tool bin 34 which depends downwardly from the platform. The tool bin may be provided with a cover or door (not shown) to keep the tools inside the bin when the vehicle is under negative-g force. Alternatively, the tool bin 34 may be coupled to the platform 12 by a hinge or gimbal so that the tools therein are always subject to a positive-g force. Although the vehicle will typically not experience g forces due to its movement, certain track inversions will cause negative or lateral g forces.

According to the invention, the maintenance vehicle 10 is self-propelled. As illustrated, the vehicle 10 is provided with a motor 36 (seen best in FIG. 3) which is mounted on the platform 12. The motor 36 is coupled to and drives a pinion or spur gear 38. As seen best in FIGS. 2, 4, and 5, the roller coaster track has been modified to include a cog rack 40. (The cog rack 40 may take the place of the inverted T-shaped rail 141 shown in previously incorporated U.S. Pat. No. 7,131,382.) The motor 36, gear 38 and cog rack 40 are all arranged at locations such that the spur or pinion gear 38 engages the cog rack 40. In the illustrated embodiment, the cog rack 40 is located above the pinion gear 38 and is mounted on the cross beam timbers F, F', etc. See, FIGS. 2, 4, and 5. Because of this arrangement of the rack and gear, there is no need for rear upper wheels as the gear and rack perform the up-stopping function sufficiently.

The motor 36 can be any type of powered motor, for example electric, gasoline, pneumatic, propane, etc. It is preferred that the power source 44 (FIGS. 1 and 3) be carried on board the vehicle. However, it is possible to construct a "third rail" type of power supply. A motor control 42 is preferably provided within easy reach of the person P riding on the vehicle 10. A presently preferred motor control 42 is a lever with a dead man's switch. Moving the lever forward causes the motor to move the vehicle forward. The more forward the lever is moved, the faster the vehicle will go. Moving the lever rearward causes the motor to move the vehicle rearward. The more rearward the lever is moved, the faster the vehicle will go. Centering the lever will stop the vehicle as will releasing the lever in whatever position it is in. If desired, the lever may be spring-loaded to return to the center position. When the lever is at center it may be locked into place and unlocked via a button (not shown) on the top or side of the lever in order to prevent accidental movement of the vehicle. The vehicle is stopped by a braking mechanism. The presently preferred embodiments utilize a Baldor motor such as those available from Reliance Electric Motors, Greenville, S.C. An alternative to using a separate braking mechanism is to place a load across the poles of an electric motor when the vehicle is to be stopped. When the vehicle is stopped on a horizontal portion of track, it may not be necessary to keep the brake applied once the vehicle has come to a stop. However, when the vehicle in another position, it will likely be necessary to keep applying the brake. Yaw, pitch, and roll sensors can be used to determine when the brake should continue to be applied or for simplicity the brake can be continuously applied whenever the control lever is centered or grip on the control lever is released, regardless of what position the vehicle is in.

If the motor 36 is a pneumatic motor, the power source 44 may be an air compressor and/or a compressed air bottle. In this case, the power source 44 may also be used to power popular pneumatically driven tools. Similarly, if the motor 36 is electric, the power source can be used to power popular electric power tools.

A manually powered drive mechanism such as pedals or a hand crank may be provided in lieu of a motor or may be provided as a back-up propulsion system in case of failure of the primary propulsion system.

Figure 4:
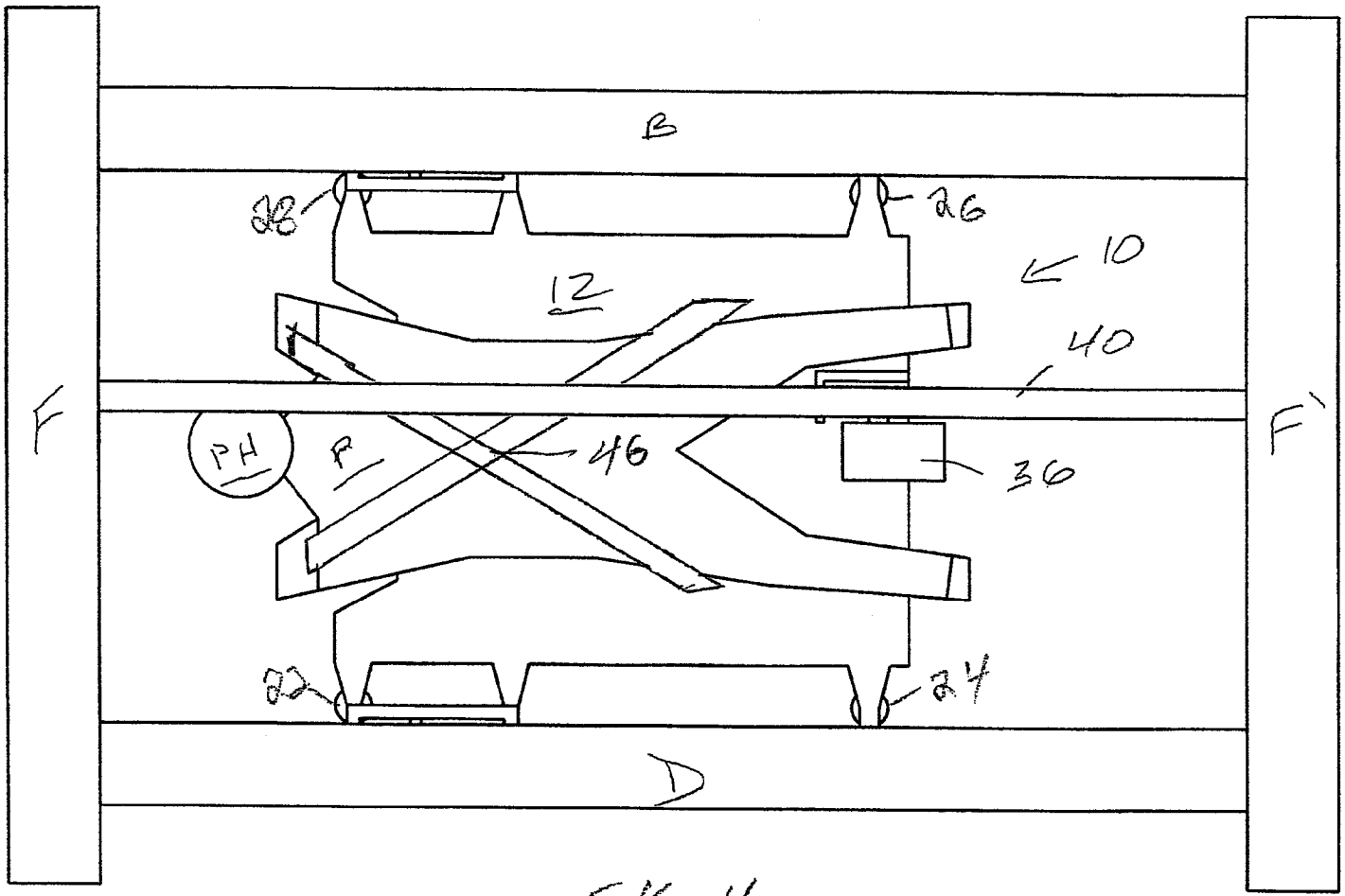
FIG. 4 is a schematic top plan view of the vehicle of FIG. 1.
Figure 5:
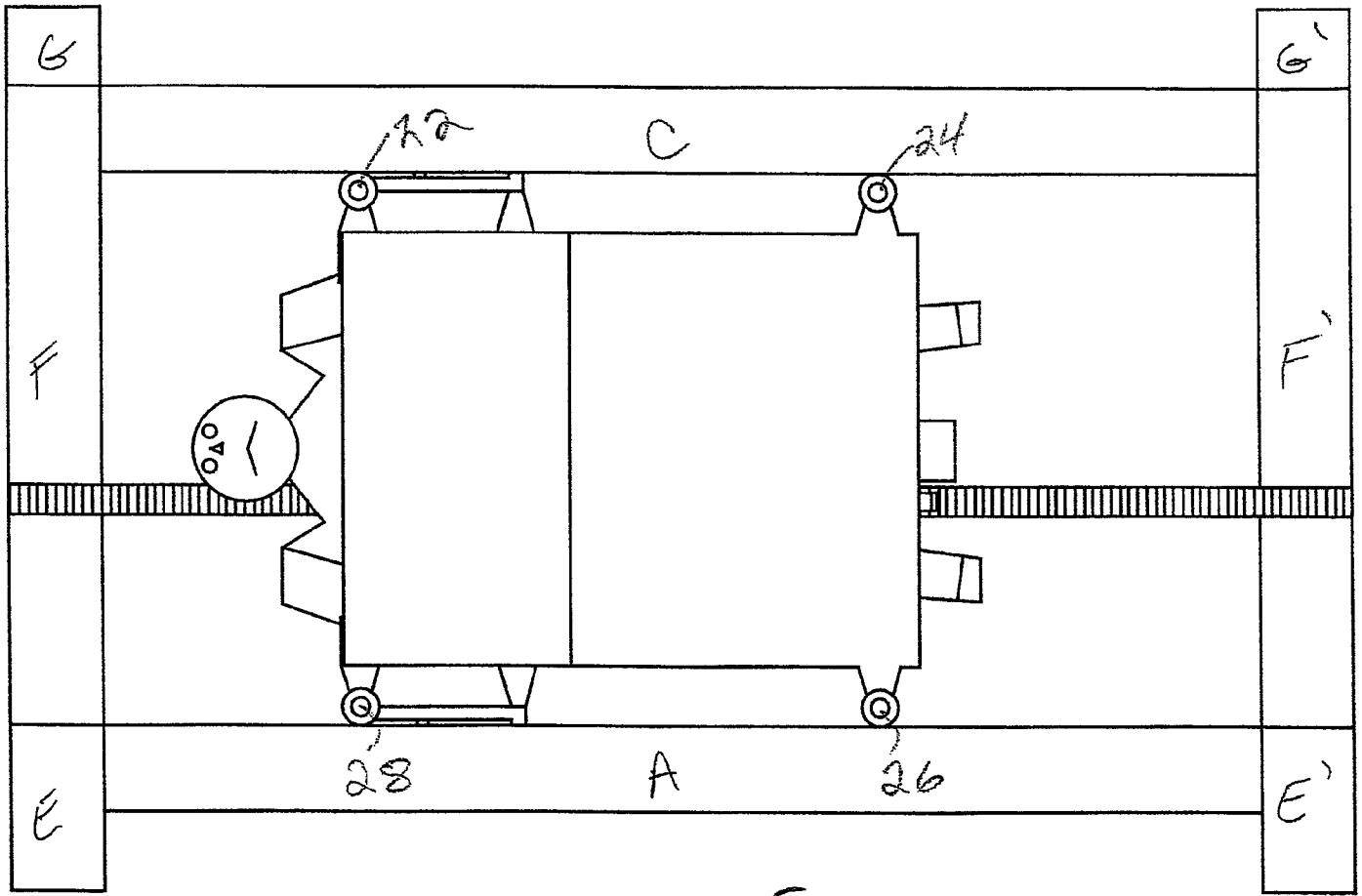
FIG. 5 is a schematic bottom plan view of the vehicle of FIG. 1.

As shown in FIG. 4, the vehicle 10 is preferably provided with a harness 46 to secure the maintenance/inspection person P who rides on the vehicle in either the prone or supine position. As seen best in FIG. 1, it will be appreciated that when in the prone position the person's head PH is in a very good position to inspect the track structures A and C and a good position to inspect track structures B and D. In the supine position, the person's head PH is in a very good position to inspect the track structures B and D and a good position to inspect track structures A and C. Depending on the gauge of the track system, the maintenance/inspection person may be able to effect repairs and maintenance without releasing the harness. In some instances, it may be necessary for the maintenance/inspection person to release the harness and slide left or right to get close enough to the track structures to make repairs or perform maintenance procedures. Alternatively, the platform 12 may be provided with a dolly-like (or creeper-like) structure (with brakes) which allows the maintenance/inspection person to slide sideways without releasing the harness. According to another aspect of the invention, if desired, the platform may be made to be gyroscopic, hinged, or weighted so that it is self-righting; i.e., it always remains parallel to the ground. According to a further aspect of the invention, if desired, the self-righting nature of the platform can be controlled by the maintenance/inspection person by actuation of a lever or switch (not shown).

Figure 7:
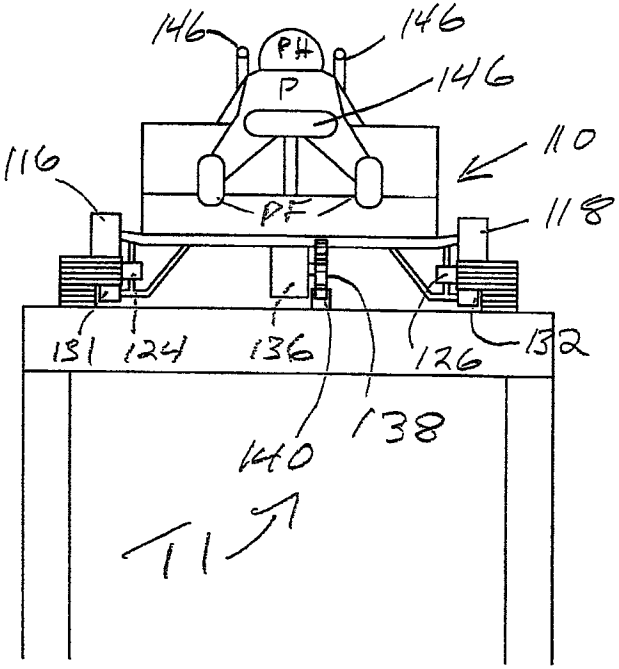
FIG. 7 is a schematic rear elevation view of the vehicle of FIG. 6.
Figure 6:
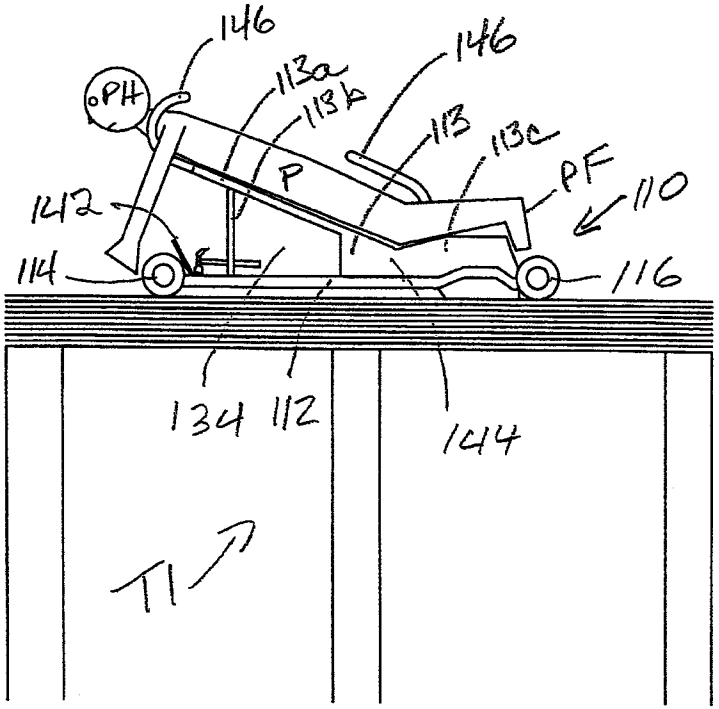
FIG. 6 is a schematic side elevation view of a second embodiment of a roller coaster maintenance vehicle according to the invention.

Turning now to FIGS. 6 and 7, a second embodiment of a roller coaster maintenance vehicle 110 is shown with similar reference numerals, increased by one hundred relative to the embodiment of FIGS. 1-5, referring to similar parts. The vehicle 110 is designed for use on a conventional wooden coaster ride with a wooden track system 1. The vehicle 110 has a platform 112 to which twelve wheels are coupled, three at each corner. Only seven of the twelve wheels can be seen in FIGS. 6 and 7. These are the positive g-force wheels 114, 116, 118, the lateral-g force wheels 124, 126, and the negative-g force wheels 131, 132. Those skilled in the art will appreciate that the front of the vehicle, which is not shown in the drawings, has the same wheel arrangement as the rear of the vehicle which is shown in FIG. 7.

Preferably, an inclined support 113 with a harness 146 is located on the platform, upon which an inspection/maintenance person P can lie in a prone position. As illustrated, the forward inclined portion 113*a* of the support is supported by one or more struts 113*b* which leave an open space 134 where tools and materials can be stored. As illustrated, the support 113 is also provided with a rearward inclined portion 113*c* which raises the person's feet PF up and away from the track structures. The inclined portions of the support 113 may be at any angle greater than zero degrees and less than ninety degrees, but twenty to forty degrees is the more useful range. As with the first embodiment, if desired, the platform may be made to be gyroscopic, hinged, or weighted so that it is self-righting, and if desired, the self-righting nature of the platform can be controlled by the maintenance/inspection person by actuation of a lever or switch (not shown).

As in the first embodiment, the vehicle 110 is provided with an on-board propulsion system which includes a motor 136 coupled to a gear 138 which engages a rack 140 which is mounted on the track system T1. A controller 142, like the controller 42 in the first embodiment, is located at a place where it can easily be reached and operated by the person P. A power supply 144 is conveniently located beneath the rearward inclined portion 113*c* of the support 113.

Figure 8:
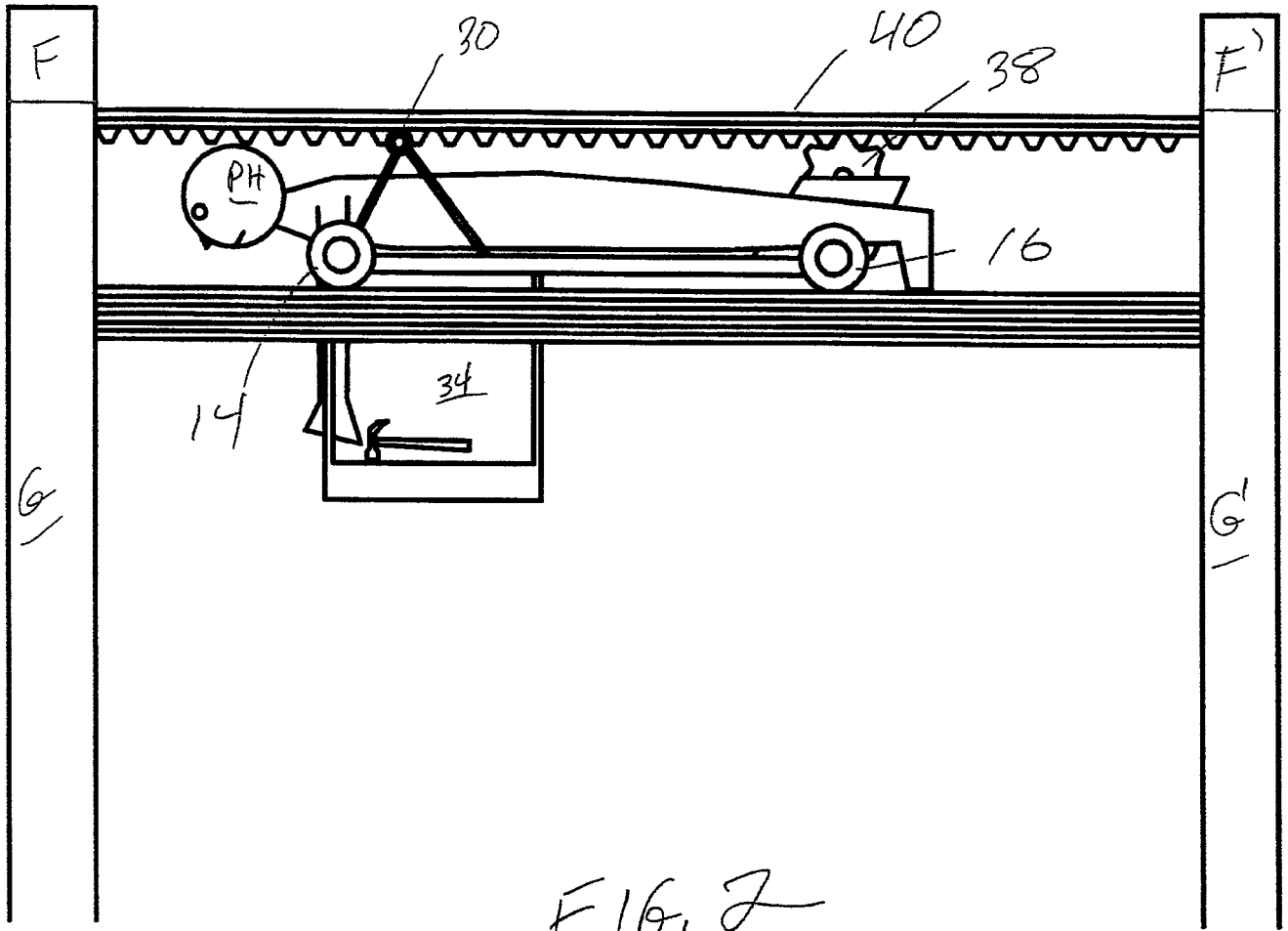
FIG. 8 is a schematic side elevation view of a third embodiment of a roller coaster maintenance vehicle according to the invention.
Figure 3:
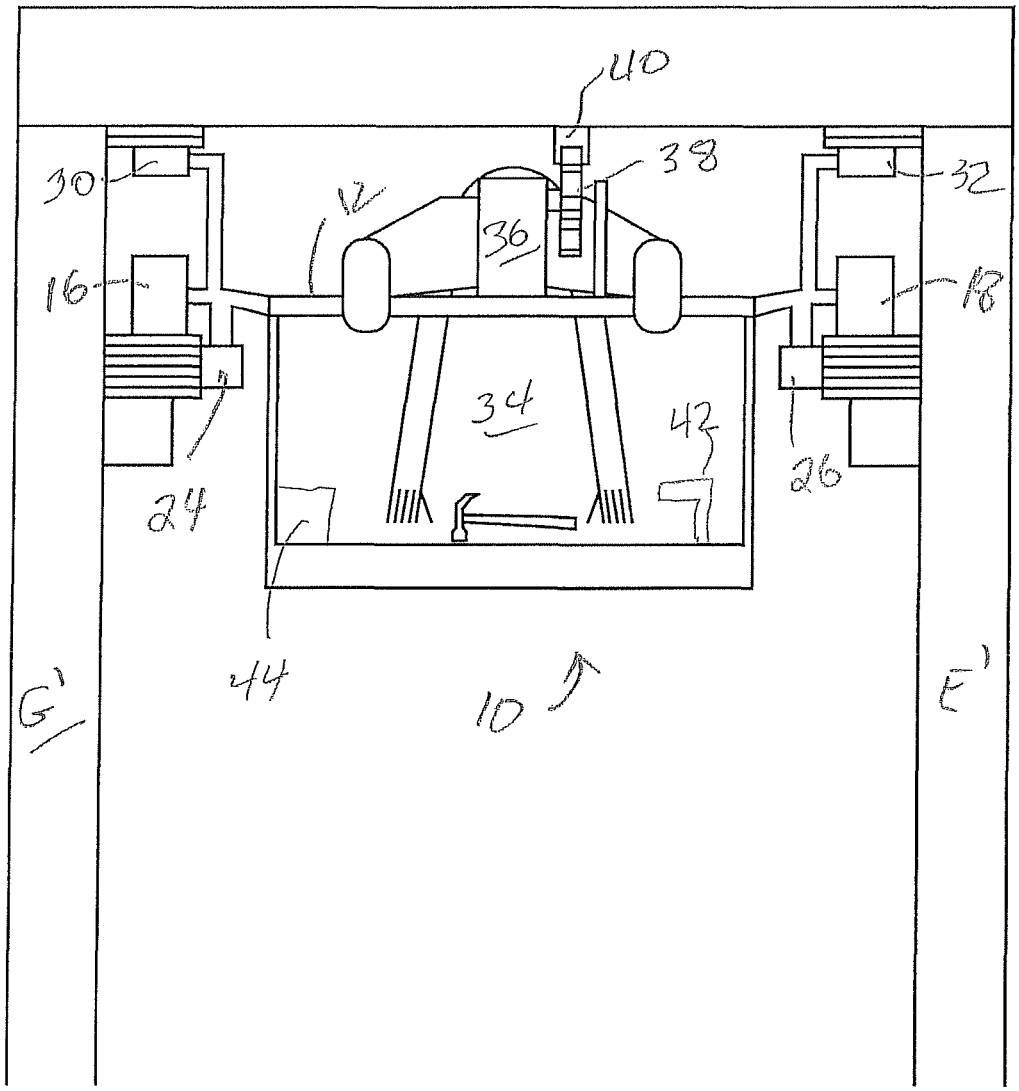
FIG. 3 is a schematic rear elevation view of the vehicle of FIG. 1.
Figure 9:
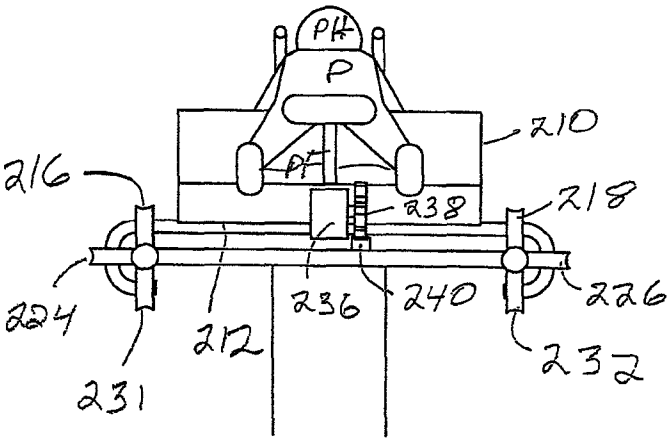
FIG. 9 is a schematic rear elevation view of the vehicle of FIG. 8.
Figure 8:
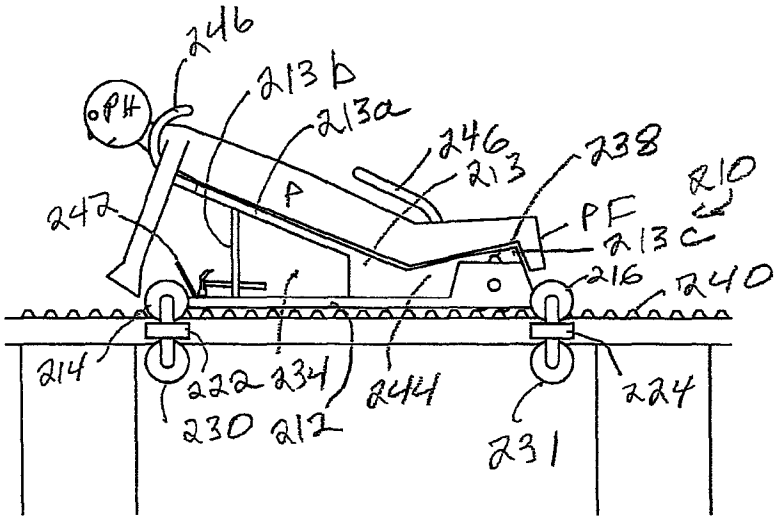

Turning now to FIGS. 8 and 9, a third embodiment of a roller coaster maintenance vehicle 210 is shown with similar reference numerals, increased by two hundred relative to the embodiment of FIGS. 1-5, referring to similar parts. The vehicle 210 is designed for use on a conventional steel coaster ride with a tubular steel track system T2. The vehicle 210 has a platform 212 to which twelve wheels are coupled, three at each corner. Only nine of the twelve wheels can be seen in FIGS. 8 and 9. These are the positive g-force wheels 214, 216, 218, the lateral-g force wheels 222, 224, 226, and the negative-g force wheels 230, 231, 232. Those skilled in the art will appreciate that front of the vehicle, which is not shown in the drawings has the same wheel arrangement as the rear of the vehicle which is shown in FIG. 9.

Preferably, an inclined support 213 with a harness 246 is located on the platform, upon which an inspection/maintenance person P can lie in a prone position. As illustrated, the forward inclined portion 213*a* of the support is supported by one or more struts 213*b* which leave an open space 234 where tools and materials can be stored. As illustrated, the support 213 is also provided with a rearward inclined portion 213*c* which raises the person's feet PF up and away from the track structures. The inclined portions of the support 213 may be at any angle greater than zero degrees and less than ninety degrees, but twenty to forty degrees is the more useful range. As with the first and second embodiments, if desired, the platform may be made to be gyroscopic, hinged, or weighted so that it is self-righting, and if desired, the self-righting nature of the platform can be controlled by the maintenance/inspection person by actuation of a lever or switch (not shown).

As in the first and second embodiments, the vehicle 210 is provided with an on-board propulsion system which includes a motor 236 coupled to a gear 238 which engages a rack 240 which is mounted on the track system T2. A controller 242, like the controller 42 in the first embodiment and the controller 142 in the second embodiment, is located at a place where it can easily be reached and operated by the person P. A power supply 244 is conveniently located beneath the rearward inclined portion 213*c* of the support 213.

Comparing FIGS. 6 and 7 with FIGS. 8 and 9, it will be appreciated that the only significant difference between the second embodiment and the third embodiment is the arrangement of the twelve wheels, the former being arranged to ride on the track system of a wooden coaster ride and the latter being arranged to ride on the track system of a steel coaster ride.

Figure 9A:
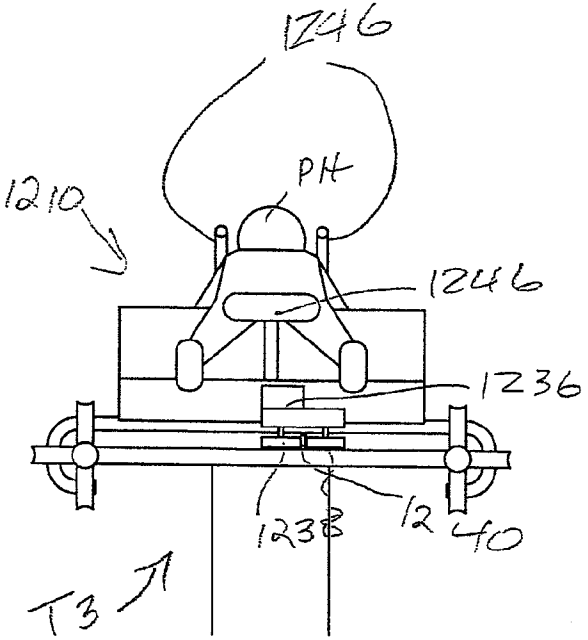
FIG. 9A is a view similar to FIG. 8 but illustrating the alternate propulsion system of FIG. 8A.
Figure 8A:
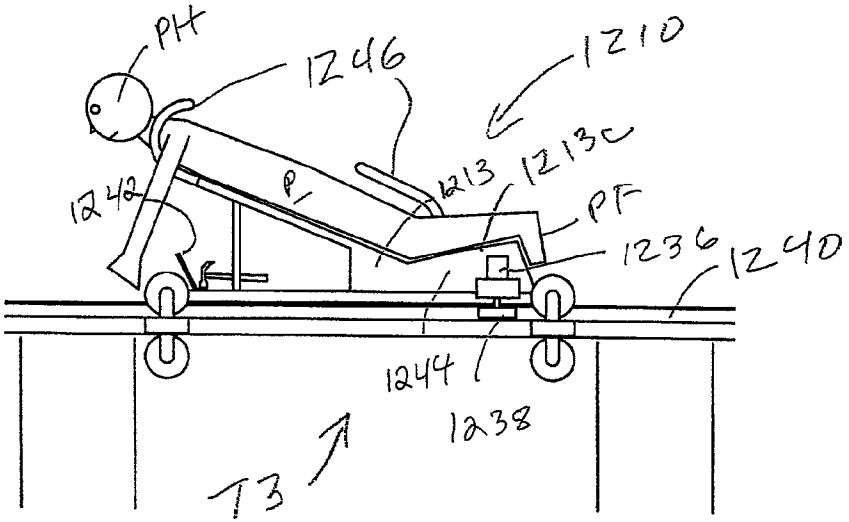
FIG. 8A is a view similar to FIG. 8 but illustrating an alternate propulsion system.

FIGS. 8A and 9A illustrate a vehicle 1210 which is similar to the vehicle 210 with similar reference numerals (increased by 1000) referring to similar parts. The only significant difference between the vehicle 1210 and the vehicle 210 is the propulsion system. In this embodiment, the propulsion system includes a motor 1236 coupled to one or two tires 1238 which engages a vertical fin 1240 which is mounted on the track system T3. A controller 1242 is located at a place where it can easily be reached and operated by the person P. A power supply 1244 is conveniently located beneath the rearward inclined portion 1213*c* of the support 1213. Two tires 1238 are preferred over a single tire but only one tire need be coupled to the motor 1236. The other tire can be an idler tire which is coupled to the powered tire and biased to press both tires onto opposite sides of the fin 1240.

Figure 10:
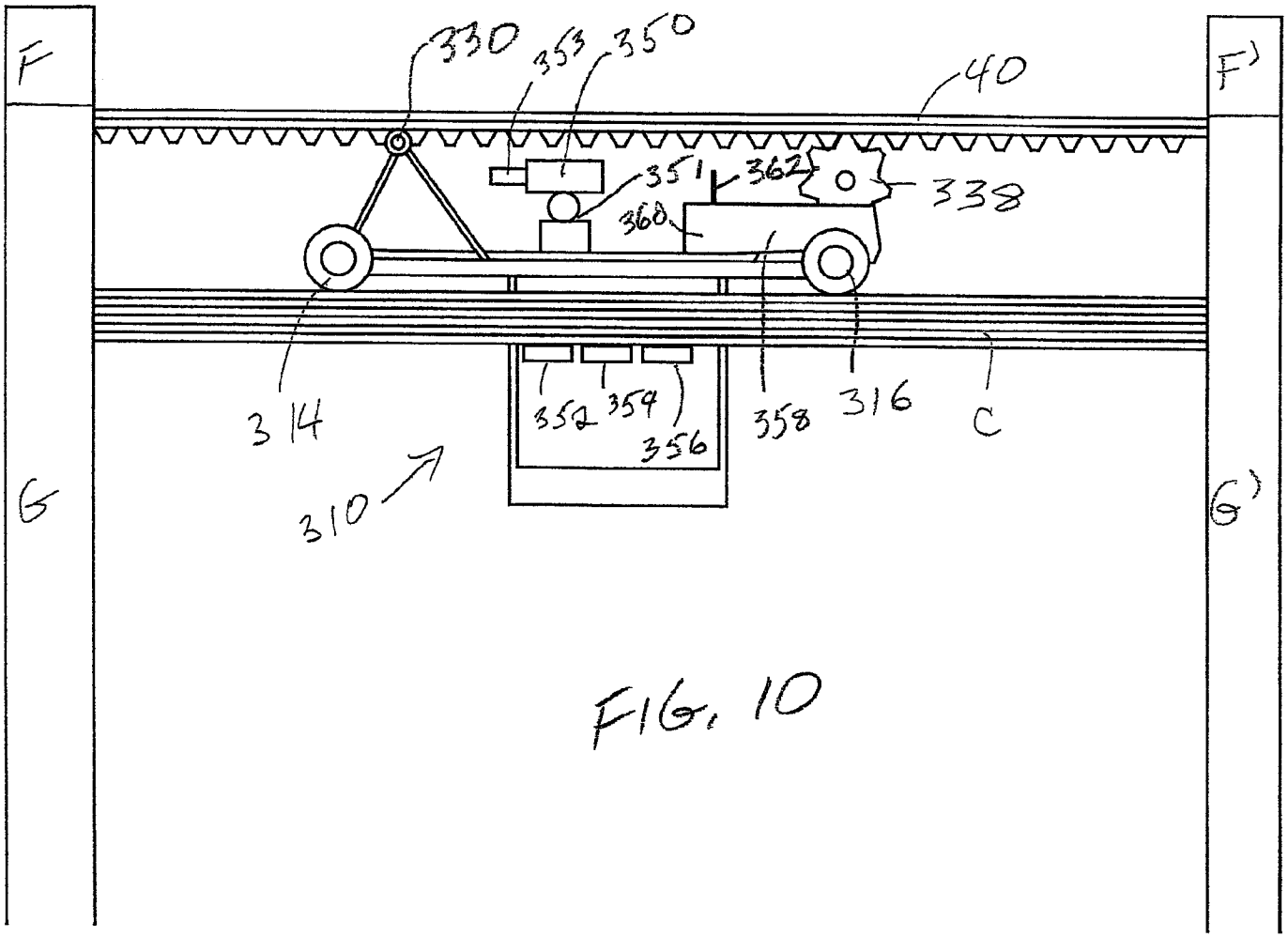
FIG. 10 is a schematic side elevation view of a fourth embodiment of a roller coaster maintenance vehicle according to the invention.

FIG. 10 illustrates a remote controlled inspection vehicle 310 according to the invention. The vehicle is designed to ride on the track system of previously incorporated U.S. Pat. No. 7,131,382. The vehicle 310 is provided with the same kinds of wheels as the vehicle 10 of FIGS. 1-5, e.g. 314, 316, 330. It is also provided with the same kind of drive pinion 338 which engages the toothed rack 340. Unlike the first embodiment, the inspection vehicle 310 is designed to be remotely operated. Thus, the vehicle is equipped with a plurality of inspection apparatus, e.g. 350, 352, 354, 356, which are coupled to electronics 358 (which includes a receiver or transceiver 360 coupled to an antenna 362). As illustrated, the inspection apparatus 350 is a video camera. The inspection apparatus 352, 354, 356 may include sensors such as an audio detector and/or an ultrasound detector. Inspection apparatus 356 may be an infrared heat source which is used in conjunction with the video camera. The video camera 350 is preferably mounted on a powered gimbal (or the like) 351 so that it can be made to pan and tilt and is preferably provided with a remotely operable zoom lens 353. From the foregoing, those skilled in the art will appreciate that a remote operator is provided with a transceiver and associated electronics (an example is described below with reference to FIG. 12) which controls the movement of the vehicle and the activation of the inspection apparatus, thereby allowing the remote operator to inspect the track system. If the remote operator discovers places where maintenance is needed, the locations are noted and a manned vehicle is sent to repair the track system.

Figure 11:
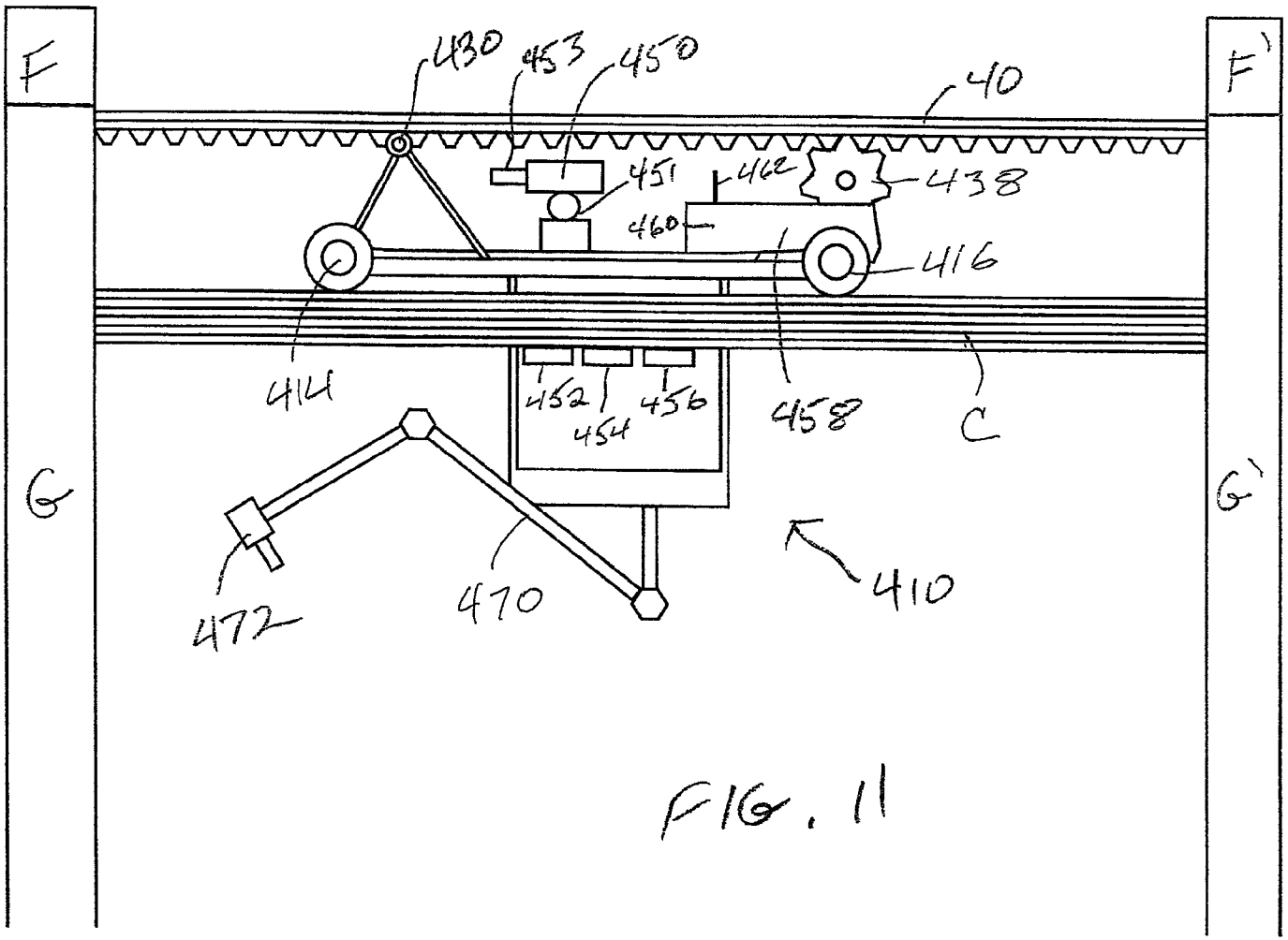
FIG. 11 is a schematic side elevation view of a fifth embodiment of a roller coaster maintenance vehicle according to the invention.

Turning now to FIG. 11, the vehicle 410 is substantially the same as the vehicle 310 described above with similar reference numerals, increased by one hundred, referring to similar parts. The only difference between vehicle 310 and vehicle 410 is that the latter is provided with a remotely controllable robot arm 470 with a remotely operable power tool 472 coupled to its free end. The tool 472 may be any of many electrically or pneumatically powered tools such as a bolt tightener, a nail gun or a grease gun. If desired, the tool may be removable from and attachable to the robot arm such that the robot arm can be controlled to pick up and utilize any of a plurality of powered tools. In this case, the vehicle 410 may be provided with a tool bin as in the previous embodiments. Preferably, the tool bin has specific locations for each power tool. From the foregoing, those skilled in the art will appreciate that a remote operator is provided with a transceiver and associated electronics (an example is described below with reference to FIG. 12) which controls the movement of the vehicle and the activation of the sensors, thereby allowing the remote operator to inspect the track system. If the remote operator discovers places where maintenance is needed, the remotely operable robot arm 470 is activated. The arm is operated so that the tool 472 is located at the location where maintenance is needed and the tool is operated to perform the maintenance. If desired, multiple tools may be used by the robot arm 470. According to another aspect of the invention, multiple robot arms may be utilized so that multiple tools may be used at the same time.

From the foregoing, those skilled in the art will appreciate that the vehicles 310 and 410 could be modified to be operable on other track systems such as the track system T1 illustrated in conjunction with the vehicle 110 or the track system T2 illustrated in conjunction with the vehicle 210.

Referring now to FIG. 12, an exemplary remote controller 500 includes a transceiver 502 coupled to an antenna 504. The transceiver is also coupled to a view screen 506 and a plurality of control inputs, e.g. 508, 510, 512, 514, 516, 518, 520, 522. As shown, control input 508 is a joystick (J), control input 510 is a scroll-wheel (S), and control inputs 512, 514 and 516 are used to direct the joystick controls to the maintenance vehicle (V) movement, the camera (C) and the robotic arm (A) respectively. Thus, for example, by pressing button 512, movement of joystick forward or backward 508 will control movement of the maintenance vehicle forward or backward. The speed of the maintenance vehicle may relate to how far the joystick is moved. When the vehicle is at a desired location and it is desired to move the direction of the camera (which is preferably on at all times with the view screen 506 showing the picture from the camera), button 514 may be pressed, and the joystick may be used to move the camera.

Likewise, scroll-wheel 510 may be used to cause the camera to zoom in and out. If a repair is required, button 516 may be pressed, and the joystick can then be used to control movement of the robotic arm. It will be appreciated that other buttons such as buttons 518, 520, etc. may be provided to control other aspects the remotely operable inspection/maintenance vehicle. By way of example only, button 518 may be a weld button which causes actuation of a power welder (e.g., to fix a crack in a track), button 518 may be a wrench button which causes actuation of a power wrench (e.g., to tighten or loosen a bolt), and button 522 may be a paint-marker button which can be used to mark an area in question so that it can be easily located by maintenance crew members. Again, buttons 518, 520, 522, etc. may impact the application of the joystick button 508 and/or the scroll-wheel button 510. For example, the power wrench might loosen a bolt when scroll-wheel is scrolled in one direction and tighten the bolt when it is scrolled in the other direction.

According to another aspect, remote controller 500 can have two modes of operation—automatic and manual. If automatic operation is engaged, the maintenance vehicle can move at a predetermined speed and scan the track for flaws using the various systems. Should a potential flaw be found, the maintenance vehicle can stop, backtrack, and rescan the area slowly. If it is confirmed that there is a problem, the remote controller 500 can audibly alert a maintenance operator, and automatic operation can be suspended until the operator takes action. The operator can then use manual operation mode to thoroughly examine the area in question, or press a button that takes a snapshot of the area in question, provides the number of feet along the track circuit that the area occurs, and optionally uses a paint gun to spray-mark the area in question so that it can be easily located by maintenance crew members. If automated repair equipment is on-board (welding, bolting, etc.) the equipment can be used to repair the area in question either automatically or under control of an operator. In manual operation mode, the maintenance vehicle motion, camera, and robotic arm are all controlled as previously described.

FIG. 12A shows a roller coaster track 700 with a maintenance vehicle M located thereon and a remote building B which houses the remote controller 500 of FIG. 12. If desired, remote controller 500 can be located in the station "ST" of the roller coaster, but regardless of whether located in a remote building or in the station, remote controller 500 is not located on the roller coaster track 700 itself. In fact, preferably, remote controller 500 is stationary, although, if desired, remote controller 500 can be placed on a vehicle, provided the vehicle is not on the coaster track 700.

Figure 13:
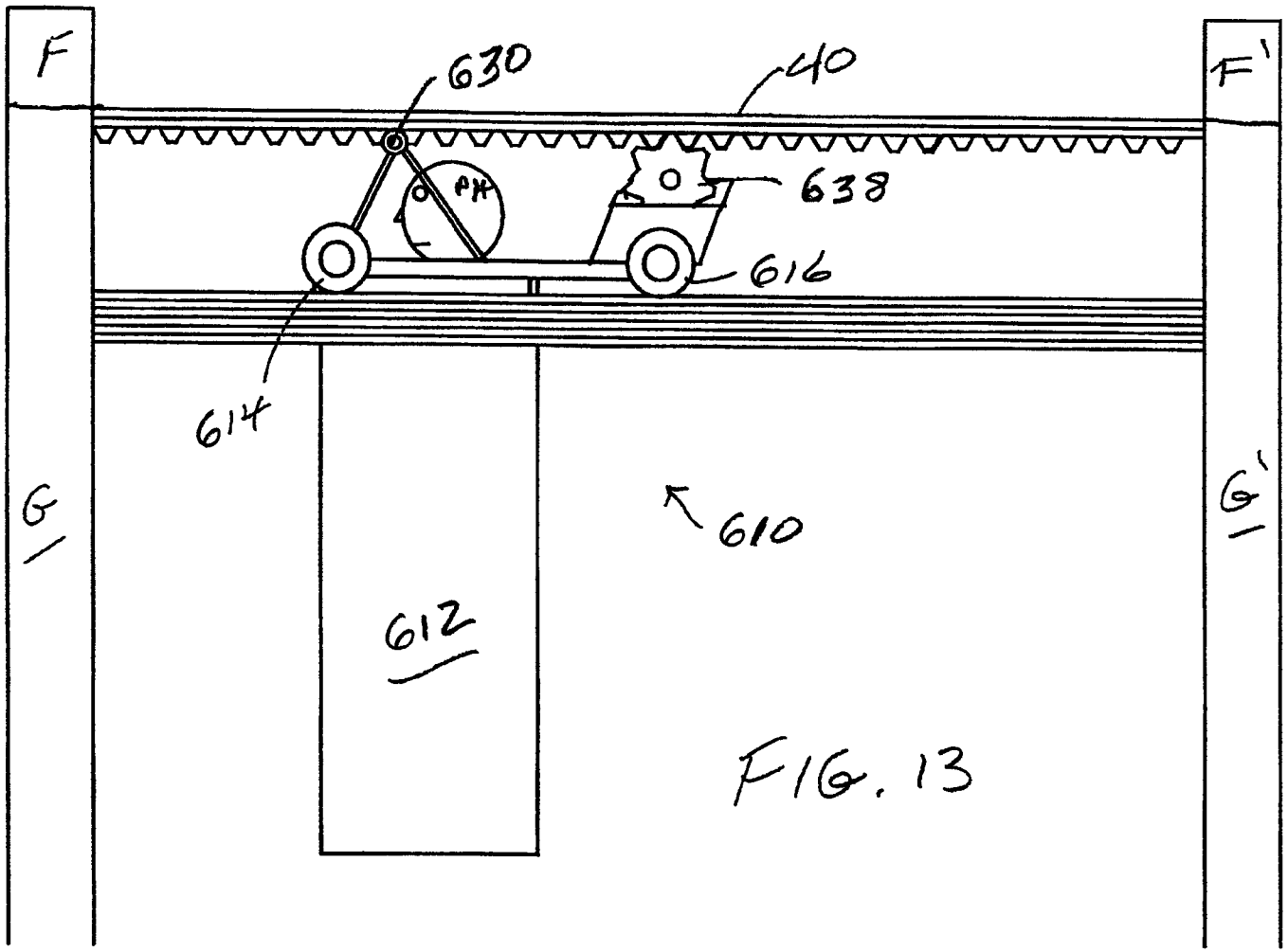
FIG. 13 is a schematic block diagram of a sixth embodiment of a roller coaster maintenance vehicle according to the invention.

FIG. 13 illustrates a sixth embodiment of a vehicle 610 according to the invention where similar reference numerals (increased by 600 relative to the embodiment of FIG. 1) refer to similar parts. Here the platform 612 includes or is in the form of a cherry picker like bucket so that the inspection/maintenance person can stand while riding the vehicle.

According to another aspect of the invention, any of the previously described maintenance vehicles may be housed on an auxiliary track of the roller coaster which is connected to the main track via a switch track. With respect to the vehicles that are operated by a maintenance worker, the worker can climb into vehicle typically either using a ladder or by hoisting him or herself up. The maintenance vehicle can be supplied with built-in retractable ladder if desired. The maintenance worker can strap seatbelts and engage safety bars or mechanisms to ensure that he or she is secured on the maintenance vehicle platform. The worker then turns on the vehicle power, and moves the vehicle out of the auxiliary track and on to main track when it is certain that no coaster cars are operational on the track. Another maintenance worker preferably closes the switch so that the vehicle remains on the normal track circuit and so that no coaster cars enter the normal track circuit. The worker causes the maintenance vehicle to move along the track using an on-board control system, going as fast or slow as needed, and stopping when desired. According to one aspect of the invention, the maintenance worker can open main safety mechanism if more room to move is required, but may only do so if tethered to the vehicle in order to prevent falling. Upon locating a location along the coaster track (whether the track itself or a support) which requires repair, the maintenance worker can use whatever tools are necessary to complete repairs. Preferably, those tools are located in a tool bin provided with the maintenance vehicle. Upon completion of the entire circuit or a portion thereof, the maintenance vehicle is returned back to the auxiliary track via the switch track and stowed there. While on the circuit, should a worker need to abandon the vehicle in case of emergency during repairs, he or she can remove the safety harness and climb or walk to safety.

According to another aspect of the invention, and with respect to maintenance vehicles that are remotely operated, when no coaster cars are operational on the coaster track, the maintenance vehicle power is turned on (either remotely or directly), and the vehicle is moved off the auxiliary track and on to main track. Using the remote control system, the maintenance vehicle is caused to move along the track at a desired speed(s) with the camera on, and stopping when desired. Upon locating a location along the coaster track (whether the track itself or a support) which requires repair, using remote controls, the location may be marked and/or tools on the maintenance vehicle may be actuated as necessary to start and/or complete repairs. Preferably, those tools are located in a tool bin provided with the maintenance vehicle. Upon completion of the entire circuit or a portion thereof under remote control, the maintenance vehicle is returned back to the auxiliary track via the switch track and stowed there.

There have been described and illustrated herein several embodiments of a roller coaster maintenance vehicle and methods of repairing a roller coaster track/support. While particular embodiments of the invention have been described, it is not intended that the invention be limited thereto, as it is intended that the invention be as broad in scope as the art will allow and that the specification be read likewise. Thus, while particular propulsion systems have been disclosed, it will be appreciated that other propulsion systems might be usable. In addition, while particular types of inspection apparatus have been disclosed, it will be understood other types of inspection apparatus might be useful. Also, while a particular remote control console has been described, it will be appreciated that a different console could be utilized with different buttons and functions. Further, while particular tools have been described, it will be appreciated that the maintenance vehicle could utilize additional and/or different tools such as e.g., a hammer. It will therefore be appreciated by those skilled in the art that yet other modifications could be made to the provided invention without deviating from its spirit and scope as claimed.

What is claimed is:

1. A method of repairing or maintaining a roller coaster track or track support which is part of a roller coaster system having roller coaster cars which are propelled along the coaster track, comprising:

a) causing a roller coaster maintenance vehicle to traverse at least a portion of said roller coaster track, said roller coaster maintenance vehicle having (i) a platform, (ii) a set of wheels operatively mounted to said platform and arranged to engage and ride on said at least one roller coaster track, said set of wheels including at least two wheels with axes of rotation substantially orthogonal to each other, (iii) a maintenance vehicle propulsion system mounted to said platform and arranged to propel said platform along said at least one track structure, said maintenance vehicle propulsion system being independent of the roller coaster propulsion system, and (iv) a repair tool supported by said maintenance vehicle; and b) using said repair tool to repair or maintain the roller coaster track or track support, wherein said roller coaster maintenance vehicle has a receiver for receiving remote control signals, and said causing and said using are accomplished by remote control signaling by an operator located off of said roller coaster track using a remote control apparatus.

2. A method according to claim 1, wherein:

said roller coaster maintenance vehicle further includes inspection apparatus.

3. A method according to claim 2, wherein:

the inspection apparatus comprises at least one of a video camera, thermal imaging apparatus, and a sound sensor.

4. A method according to claim 2, wherein:

said roller coaster maintenance vehicle further comprises powered repair/maintenance equipment coupled to said receiver.

5. A method according to claim 4, wherein:

said powered repair/maintenance equipment includes a robotic arm.

6. A method according to claim 1, wherein:

said platform is configured to support at least one person, and the person causes the roller coaster maintenance vehicle to traverse at least a portion of the roller coaster track and uses the repair tool to repair the roller coaster track or track support.

7. A method according to claim 6, wherein:

said platform supports the at least one person in a prone or supine position.

8. A method according to claim 6, wherein:

said roller coaster maintenance vehicle has a controller coupled to said maintenance vehicle propulsion system and located where the person can operate said controller.

9. The method according to claim 8, wherein:

said controller is configured (i) to cause said maintenance vehicle propulsion system to propel said maintenance vehicle both forward and backward, and (ii) to cause said maintenance vehicle propulsion system to stop said maintenance vehicle.

10. A remote control roller coaster inspection system for a roller coaster having at least one track structure and a roller coaster propulsion system operatively arranged to propel roller coaster cars along said at least one track structure, said inspection system comprising:

a) a remote control inspectional vehicle having (i) a platform, (ii) a set of wheels operatively mounted to said platform and arranged to engage and ride on the at least one roller coaster track structure, (iii) an inspection vehicle propulsion system including a motor mounted to said platform and arranged to propel said platform along said at least one track structure, said inspection vehicle propulsion system being independent of the roller coaster propulsion system, (iv) at least one inspection apparatus coupled to said platform, and (v) a transceiver coupled to said at least one inspection apparatus; and b) a remote controller located off of said roller coaster track structure, said remote controller having a (i) transceiver, (ii) a view screen for viewing information obtained by said at least one inspection apparatus, and (iii) control apparatus for controlling movement of said inspection vehicle and for controlling said at least one inspection apparatus.

11. An inspection system according to claim 10, wherein:

said remote control inspection vehicle further comprises powered repair/maintenance equipment coupled to said platform and coupled to said transceiver, and said remote controller further comprises additional control apparatus for controlling said powered repair/maintenance equipment.

* * * * *